US009617804B2

(12) United States Patent
Buettner

(10) Patent No.: US 9,617,804 B2
(45) Date of Patent: Apr. 11, 2017

(54) DRILL ROD MAGAZINE

(71) Applicant: BAUER MASCHINEN GMBH, Schrobenhausen (DE)

(72) Inventor: Hannes Rainer Buettner, Hollenbach (DE)

(73) Assignee: BAUER Deep Drilling GmbH, Schrobenhausen (DE)

( * ) Notice: Subject to any disclaimer, the term of this patent is extended or adjusted under 35 U.S.C. 154(b) by 134 days.

(21) Appl. No.: 14/719,140

(22) Filed: May 21, 2015

(65) Prior Publication Data

US 2015/0335152 A1 Nov. 26, 2015

(30) Foreign Application Priority Data

May 21, 2014 (EP) ..... 14169255

(51) Int. Cl.
*E21B 19/14* (2006.01)
*A47B 43/00* (2006.01)

(52) U.S. Cl.
CPC ..... *E21B 19/14* (2013.01); *A47B 43/00* (2013.01)

(58) Field of Classification Search
CPC ..... E21B 19/14; E21B 7/023; E21B 19/15; E21B 19/20; E21B 19/163; A47B 47/028; A47B 43/00; A47F 5/10
USPC ..... 414/22.63–22.69, 22.61; 211/70.4, 195, 211/149, 201, 60.1, 49.1, 194; 175/85, 52
See application file for complete search history.

(56) References Cited

U.S. PATENT DOCUMENTS 1,167,550 A * 1/1916 Forsyth ..... A47F 5/13 108/163
1,716,466 A * 6/1929 Sims ..... A47B 3/12 211/149
1,912,425 A * 6/1933 Baumer ..... E04H 1/1244 135/145
2,161,719 A 6/1939 Minyard et al.
2,311,932 A * 2/1943 Deckard ..... E21B 19/14 182/38

(Continued)

FOREIGN PATENT DOCUMENTS

DE 69229748 T2 3/2000
DE 69825528 T2 8/2005

(Continued)

OTHER PUBLICATIONS

European Search Report; EP14169255; Oct. 14, 2014.

*Primary Examiner* — Daniel J Troy
*Assistant Examiner* — Hiwot Tefera
(74) *Attorney, Agent, or Firm* — Studebaker & Brackett PC

(57) ABSTRACT

The invention relates to a drill rod magazine for vertical storage of drill rod elements, having a box-like basic frame which has a support area, vertical side walls and at least one horizontal receiving shelf, which is designed to receive and hold the drill rod elements. The basic frame has a laterally open access area, via which the drill rod elements can be inserted into the basic frame. It is provided according to the invention that the side walls are arranged parallel to each other and each have at least one pivot bearing with a horizontally orientated pivot axis, the at least one receiving shelf is mounted pivotably with respect to the side walls, and the basic frame is designed to be collapsible, wherein the basic frame can be unfolded from a folded-up position into an operating position.

12 Claims, 5 Drawing Sheets

(56) References Cited

U.S. PATENT DOCUMENTS

| | | | | |
|---|---|---|---|---|
| 4,489,526 | A | 12/1984 | Cummins | |
| 4,765,401 | A | 8/1988 | Boyadjieff | |
| 5,131,547 | A * | 7/1992 | Goldberg | A47F 5/13 108/166 |
| 5,375,667 | A | 12/1994 | Trevisani | |
| 6,113,334 | A | 9/2000 | Riva | |
| 8,959,874 | B2 * | 2/2015 | Wasterval | E21B 7/021 52/117 |
| 9,198,508 | B1 * | 12/2015 | Kufel | A47F 5/116 |
| 9,226,574 | B1 * | 1/2016 | Chen | A47B 43/00 |
| 9,228,398 | B2 * | 1/2016 | Behrens | E21B 19/14 |
| 2006/0104747 | A1 * | 5/2006 | Zahn | E21B 19/14 414/22.63 |
| 2009/0053013 | A1 | 2/2009 | Maltby | |
| 2009/0218138 | A1 | 9/2009 | Donnally et al. | |
| 2009/0283324 | A1 | 11/2009 | Konduc et al. | |
| 2011/0072737 | A1 | 3/2011 | Wasterval | |
| 2011/0220604 | A1 * | 9/2011 | Ma | A47B 31/04 211/199 |

FOREIGN PATENT DOCUMENTS

| | | | |
|---|---|---|---|
| DE | 102012209988 | A1 | 10/2013 |
| EP | 2642065 | A2 | 9/2013 |

* cited by examiner

DRILL ROD MAGAZINE

The invention relates to a drill rod magazine for vertical storage of drill rod elements, having a box-like basic frame which has a support area, vertical side walls and at least one horizontal receiving shelf which is designed to receive and hold the drill rod elements, wherein the basic frame has a laterally open access area, via which the drill rod elements can be inserted into the basic frame, according to the preamble to claim 1.

Generic drill rod magazines are known from DE 698 25 528 T2 and DE 692 29 748 T2. In the case of these known drill rod magazines, pre-assembled box-like basic frames are provided which are transported to a deep drilling rig and erected there by means of a crane. Both the transport of the box-like basic frame and also the erection thereof require great resources and a correspondingly designed lifting tool, in particular a crane, is necessary.

A simplified drill rod magazine with a single central support is known from U.S. Pat. No. 4,765,401. The individual drill rod elements can have a length of 10 m and more in particular for a deep drilling rig. For storing several dozen drill rod elements, a stable middle support is to be provided in the known drill rod magazine which is sufficiently secure with respect to a risk of buckling. The arrangement as a whole thus requires great resources.

US 2011/0072737 A1 discloses a transportable drilling rig that can be erected. A box-like and telescopic drilling rig is placed on a support area. The support area is itself designed to be telescopic via a lifting arrangement. Storage of drill rod elements can be provided along the drilling rig.

A comparable drilling rig is known from US 2009/0283324 A1.

Substructure modules for mobile drilling rigs that can be assembled and dismantled are known from DE 10 2012 209 988 A1, US 2009/0218138 A1 or U.S. Pat. No. 4,489,526. By means of corresponding pivot mechanisms an upper drilling platform can be pivoted vertically upwards with respect to a lower support plate.

It is the object of the invention to indicate a drill rod magazine for vertical storage of drill rod elements which is stable and can be easily transported and efficiently constructed.

The object is achieved according to the invention by a drill rod magazine having the features of claim 1. Preferred embodiments of the drill rod magazine are indicated in the dependent claims.

The drill rod magazine according to the invention is characterised in that the side walls are arranged parallel to each other and each have at least one pivot bearing with a horizontally orientated pivot axis, the at least one receiving shelf is mounted so that it can be pivoted with respect to the side walls and the basic frame is designed so that it can be folded up or collapsed, wherein the basic frame can be unfolded from a folded-up collapsed position into an operating position.

A core idea of the invention is to construct the drill rod magazine from a box-like basic frame which is designed to be collapsible. For this, the support area, the side walls and the at least one receiving shelf are mounted so as to be pivotable relative to each other about pivot bearings. In particular, all the pivot axes of the pivot bearings are substantially horizontally orientated so that the basic frame can be unfolded from a folded-up collapsed position into an operating position and erected. In the collapsed position the wall and shelf part are approximately parallel to each other so that simple transport is possible. Through the pivotable connection of the individual parts of the basic frame these parts can be moved into the operating position without great assembly and adjustment efforts.

In principle, the unfolding of the folded-up basic frame can be realised via a separate adjusting means, in particular a crane. According to a preferred embodiment of the invention an adjusting cylinder arrangement having at least one adjusting cylinder is provided, with which the basic frame can be unfolded. The adjusting cylinder arrangement is thereby an integral constituent part of the drill rod magazine so that a special lifting tool does not therefore have to be provided at the construction or drilling site.

According to a preferred development of the invention the adjusting cylinder arrangement has at least two adjusting cylinders which are arranged parallel to each other along a side wall. A particularly stable and compact arrangement is hereby created. The adjusting cylinders are preferably designed as hydraulic cylinders. At a construction site it is merely necessary to connect the hydraulic cylinders to a hydraulic fluid source. Upon provision of the required hydraulic pressure the hydraulic cylinders can unfold and erect the drill rod magazine, which can reach a height of up to 20 m or more, without further aids from externally.

According to a further preferred embodiment of the invention the side walls are constructed from at least two wall elements, between which pivot bearings are arranged. The two outer side walls do not have to have the same number of wall elements. One side wall preferably has three wall elements, while the opposing side wall has merely two wall elements. The wall elements are respectively interconnected via a horizontal pivot bearing. Desired dimensioning of the drill rod in the folded-up collapsed position can be achieved through the corresponding arrangement of the number of wall elements and pivot bearings. In particular the drill rod magazine can be dimensioned in the collapsed position in such a way that it can be transported with a conventional transport container or a usual low loader.

A particularly compact arrangement is preferably achieved according to the invention in that the side walls are respectively arranged via a pivot bearing in a jointed manner on the support area. The support area can thereby be designed like the other wall elements in the manner of a framework or solidly in order to receive greater bearing forces. The support area can also be described as a support floor or support plate.

For secure and reliable unfolding and also folding-up of the drill rod magazine, it is advantageous according to a further embodiment of the invention to arrange at least one laterally projecting support on the support area, on which a support arm is pivotably mounted. The laterally projecting support and the pivot arm are thereby dimensioned so that they ensure a favourable force distribution in particular in the initial phase of the unfolding movement. In this way, economical dimensioning of the adjusting cylinder arrangement can be achieved.

A particularly good force distribution is thereby possible according to a variant in that the at least one adjusting cylinder is coupled on the one hand to a first wall element of a first side wall and on the other hand to a lever mechanism with two elbow levers, of which a first elbow lever is connected in a jointed manner to the first wall element and a second elbow lever to a second wall element of the first side wall which is adjacent to the first wall element of the first side wall. In the case of provision of a second or more adjusting cylinders, further elbow lever mechanisms are correspondingly to be provided. In particular at the start of the unfolding movement it is possible via the elbow lever mechanism, at the elbow point of which the adjusting cylinder is coupled, to bring about a good, transversely orientated force distribution on the approximately horizontally lying wall elements. The first and second wall element can be connected solely via the elbow lever mechanism or also via a pivot bearing.

A further improvement in the introduction of force is achieved according to a further variant in that the support arm is connected directly or via a coupling lever to the second wall element in a jointed manner. The support arm can contribute to an improved force distribution and furthermore constitute an additional guidance in the unfolding movement. It is hereby possible to counteract a risk of jamming or buckling of the frame-like wall elements.

In principle the basic frame can have merely two side walls. A particularly stable structure for a larger number of drill rod elements is achieved according to a further embodiment of the invention by the basic frame having at least one vertical intermediate wall which is arranged between and parallel to the side walls. In particular it is also possible to arrange two or more intermediate walls in parallel between the outer side walls. The distance between the individual walls is thereby preferably designed to be equal. The at least one intermediate wall brings about an additional reinforcement and thus contributes to the increased stability of the basic frame.

According to a further embodiment of the invention it is advantageous that the intermediate wall is formed like a second side wall with the same number of wall elements and that a first side wall is connected to the support arm and has a smaller number of wall elements. The one or more intermediate walls can thus be designed to be equal to at least one side wall. This allows an efficient production.

Furthermore a stable and at the same time light structure is achieved according to a variant of the invention by the wall elements being constructed in the manner of a truss from metal beams. In particular steel beams, for example T shaped or double T shaped beams, can be provided which are welded to each other to form the wall elements.

In principle the design of the at least one receiving shelf which is arranged above the support area can be as desired, provided that receiving and holding of the drill rod elements are ensured. A particularly robust embodiment is achieved according to a development of the invention by the receiving areas for the drill rod elements being formed on the receiving shelf through tracks arranged in the manner of a rake which extend approximately horizontally away from a transverse beam to the open access area. Two or more receiving shelves are preferably distributed over the height of the basic frame in order to thus facilitate secure storage of the drill rod elements. The arrangement with tracks allows a reliable storage of the drill rod elements in rows. A plurality of receiving shelves can be arranged one on top of the other so that drill rod elements of different lengths or rod parts put together can be held and supported.

According to a development of the invention it is advantageous for a compact structure that the side walls and the at least one vertical intermediate wall are pivotably mounted on the support area via a respective baseboard and that the baseboards each have a different height that decreases in a folding direction. In this way the horizontally arranged elements can be arranged extensively parallel to each other in the folded-up position. The height difference of the individual baseboards thereby amounts to the width of the wall elements or a multiple thereof.

The invention will be explained further below by reference to a preferred exemplary embodiment which is schematically shown in the attached drawings, in which.

Figure 1:
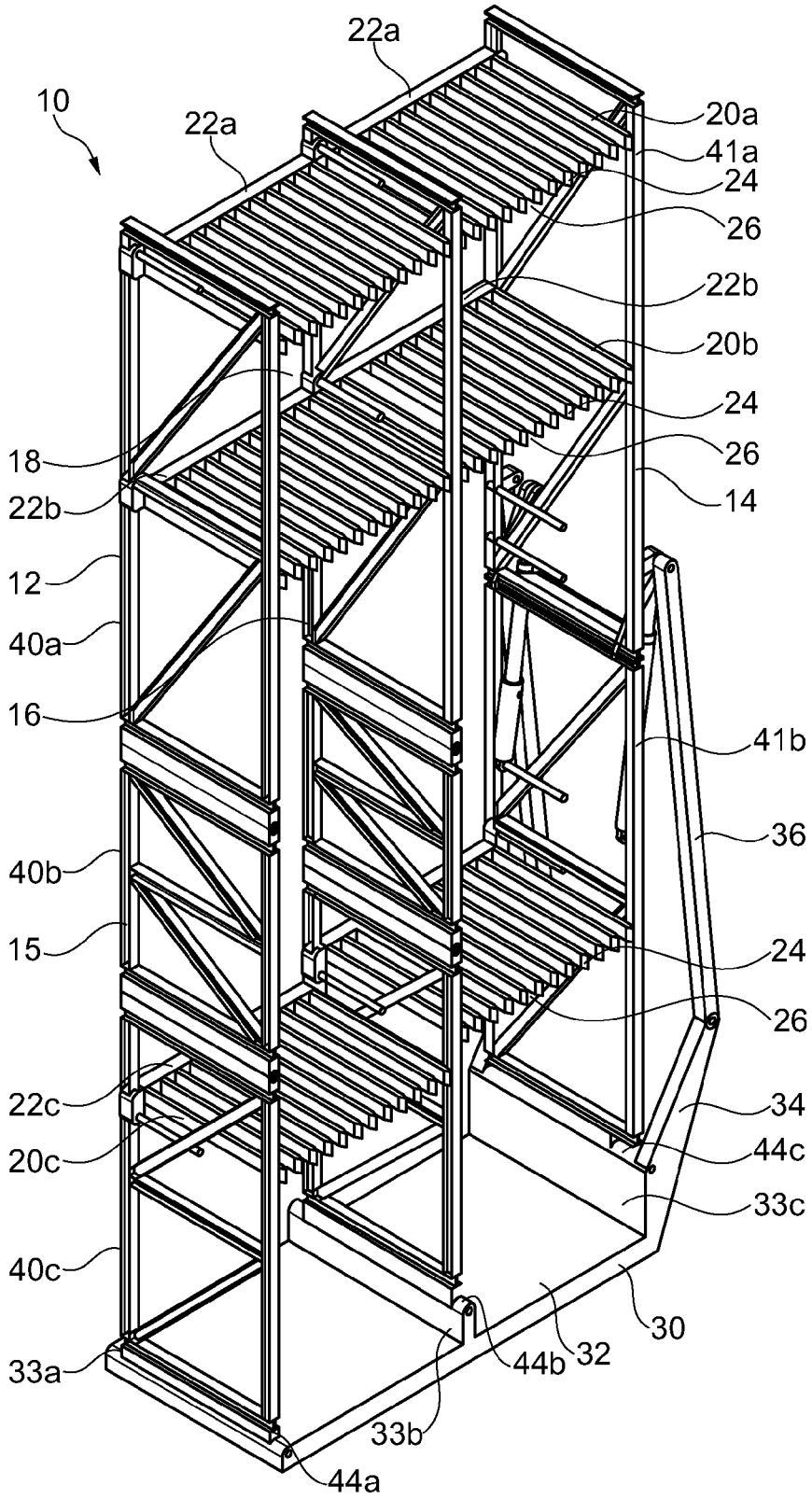
FIG. 1 shows a perspective view of a drill rod magazine according to the invention in the unfolded operating state, from the front.
Figure 2:
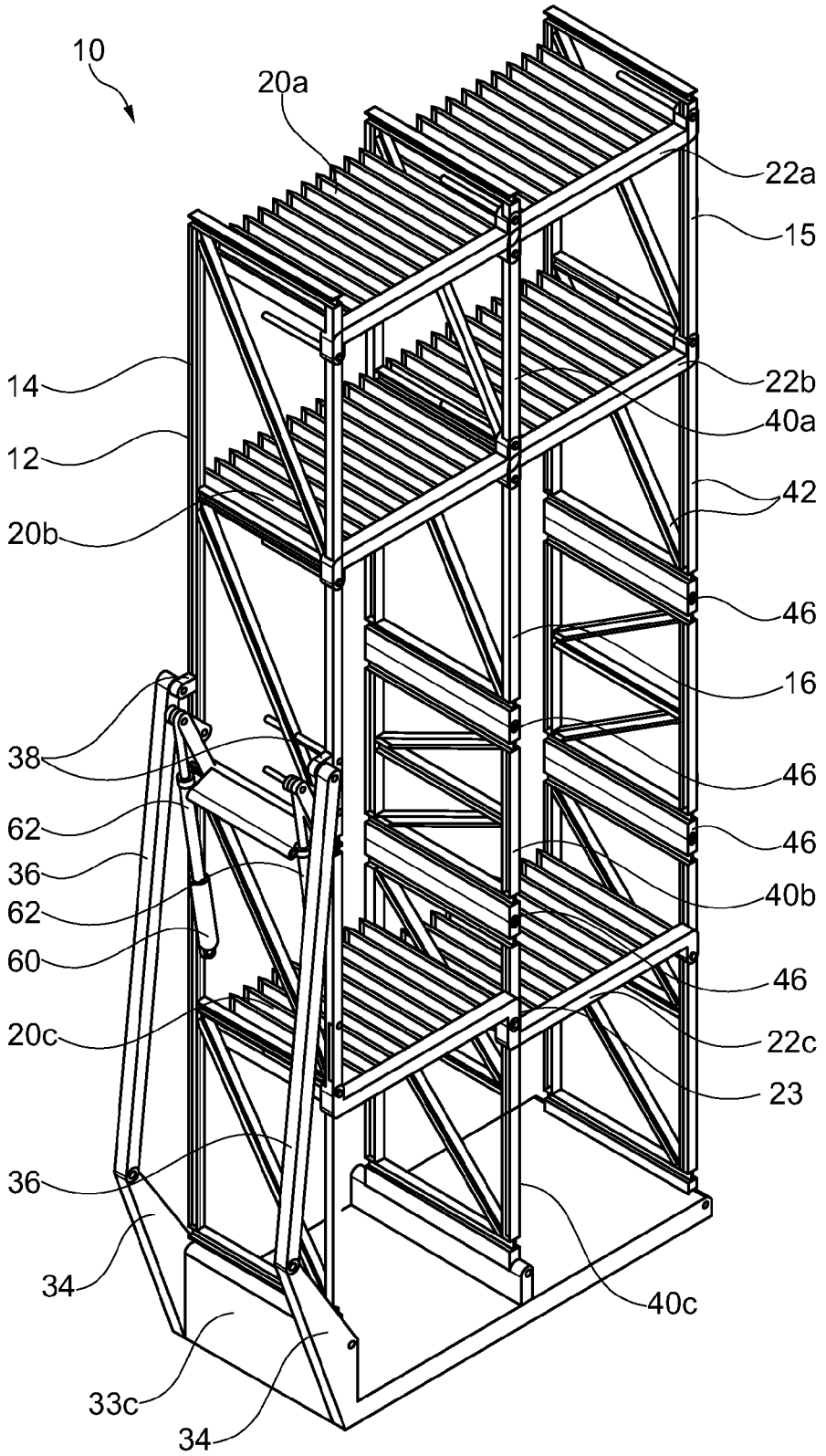
FIG. 2 shows a perspective view of the drill rod magazine of FIG. 1, from the rear.
Figure 5:
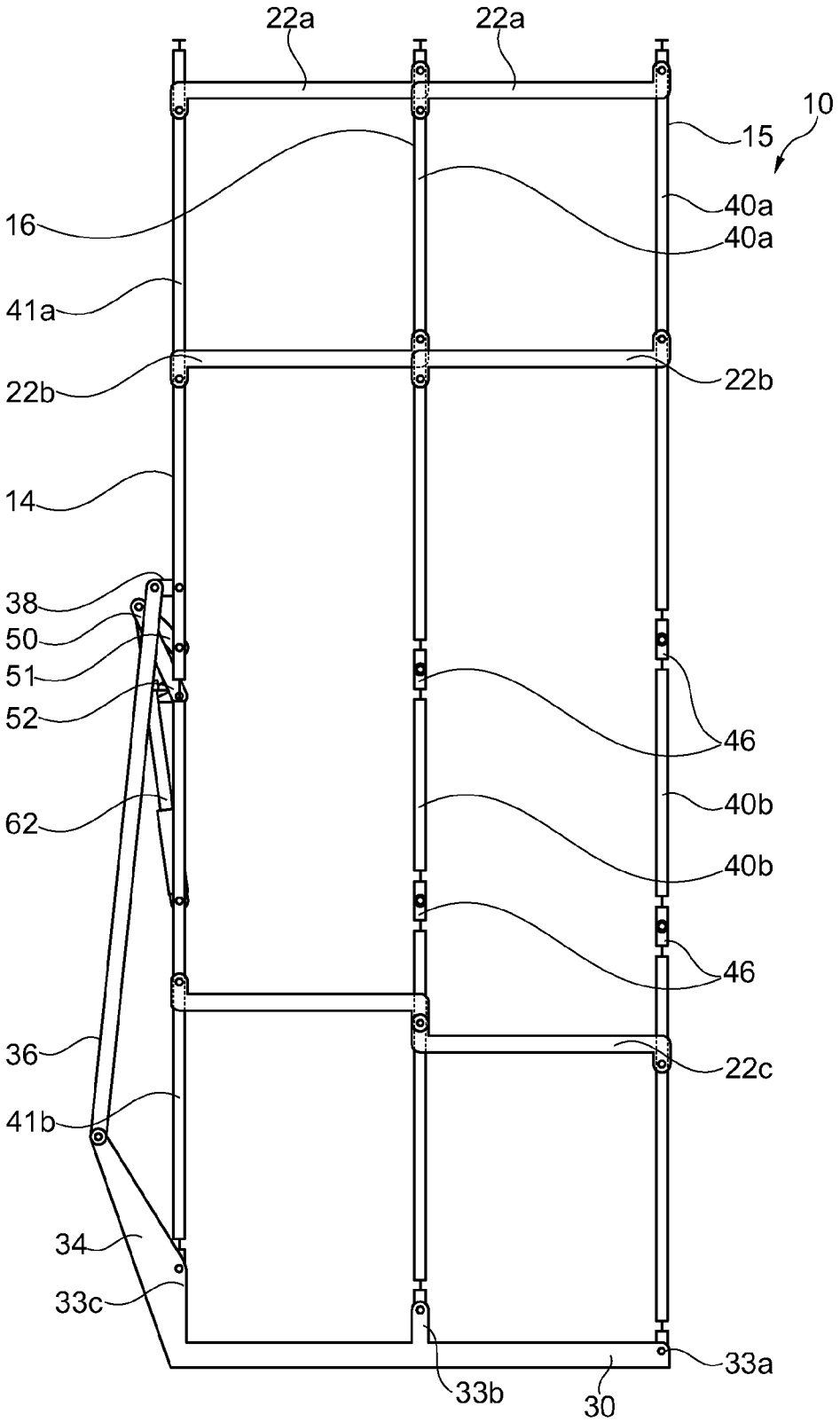
FIG. 5 shows a side view of the drill rod magazine of FIG. 2 in an unfolded operating state, in a side view.

FIGS. 1, 2 and 5 show a drill rod magazine 10 according to the invention in an unfolded operating state. The drill rod magazine 10 has a box-like basic frame 12 which comprises a plate-like support area 30. Similarly to a framework, a first side wall 14, an opposing second side wall 15 and an interposed intermediate wall 16 are arranged on a base plate 32 of the support area 30. The first side wall 14, the second side wall 15 and the intermediate wall 16 extend vertically and parallel to each other up to an equal height. First receiving shelves 20*a*, second receiving shelves 20*b* and third receiving shelves 20*c* are provided between the vertically orientated walls substantially in three height ranges and are arranged substantially horizontally. The receiving shelves 20 each have a transverse beam 22, on which a plurality of transversely orientated tracks are arranged which extend in a horizontal direction in the manner of a rake to a front open access area 18 of the drill rod magazine 10. Slot-like gaps are arranged between the individual tracks 24 which are formed as receiving areas 26 for insertion of vertically orientated drill rod elements. The drill rod elements lie on the support area and extend in dependence upon their length at least to the lower receiving shelf 20*c*.

For folding up the drill rod magazine 10, the first side wall 14 is mounted pivotably on a lateral baseboard 33*c* via a lower pivot bearing 44*c* with a horizontally orientated pivot axis. The first side wall 14 further comprises an upper first wall element 41*a* and a lower second wall element 41*b* which are held so that they can be folded relative to each other.

Figure 3:
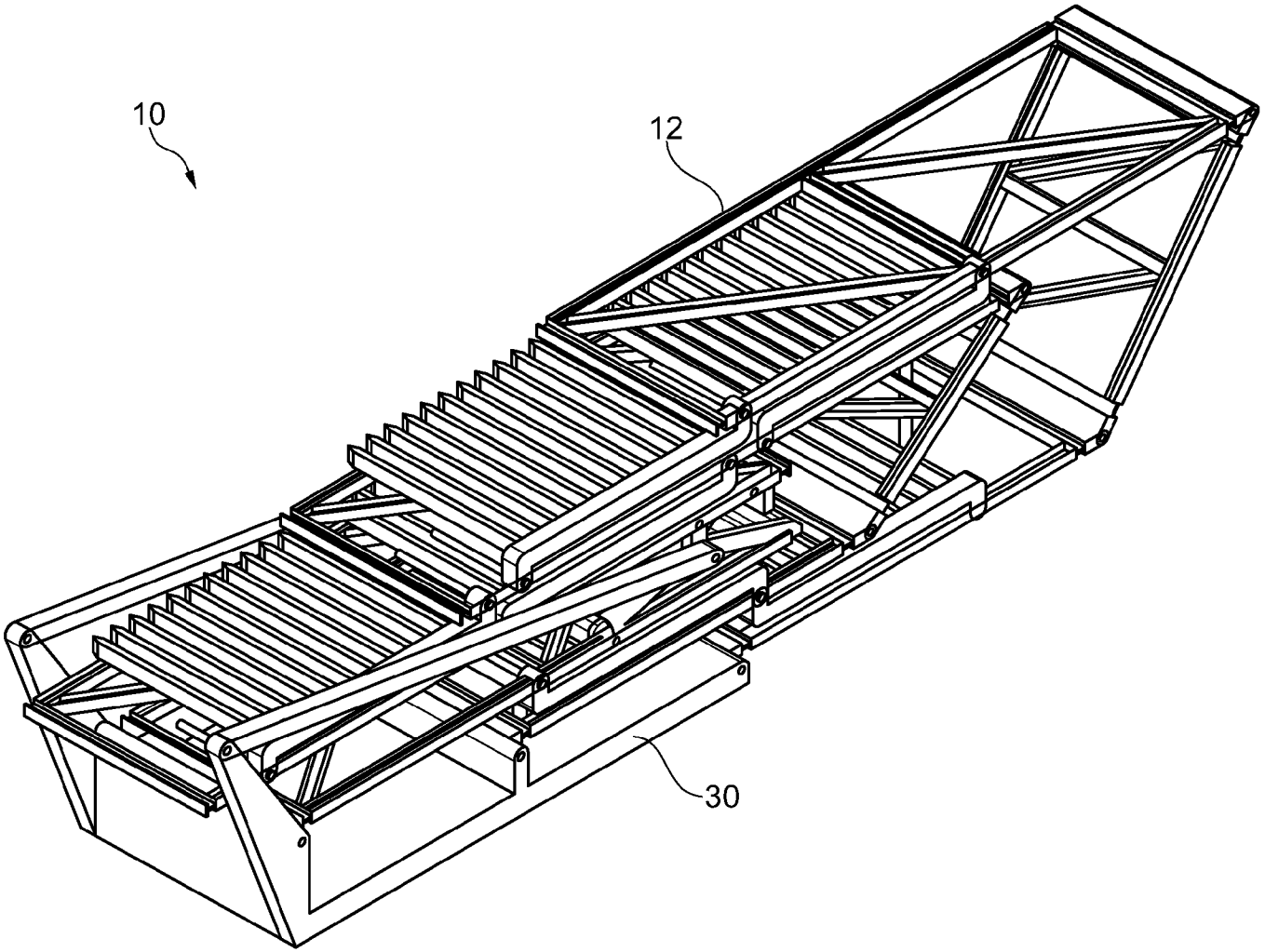
FIG. 3 shows a perspective view of the drill rod magazine of FIG. 2 in a folded-up collapsed position.
Figure 4:
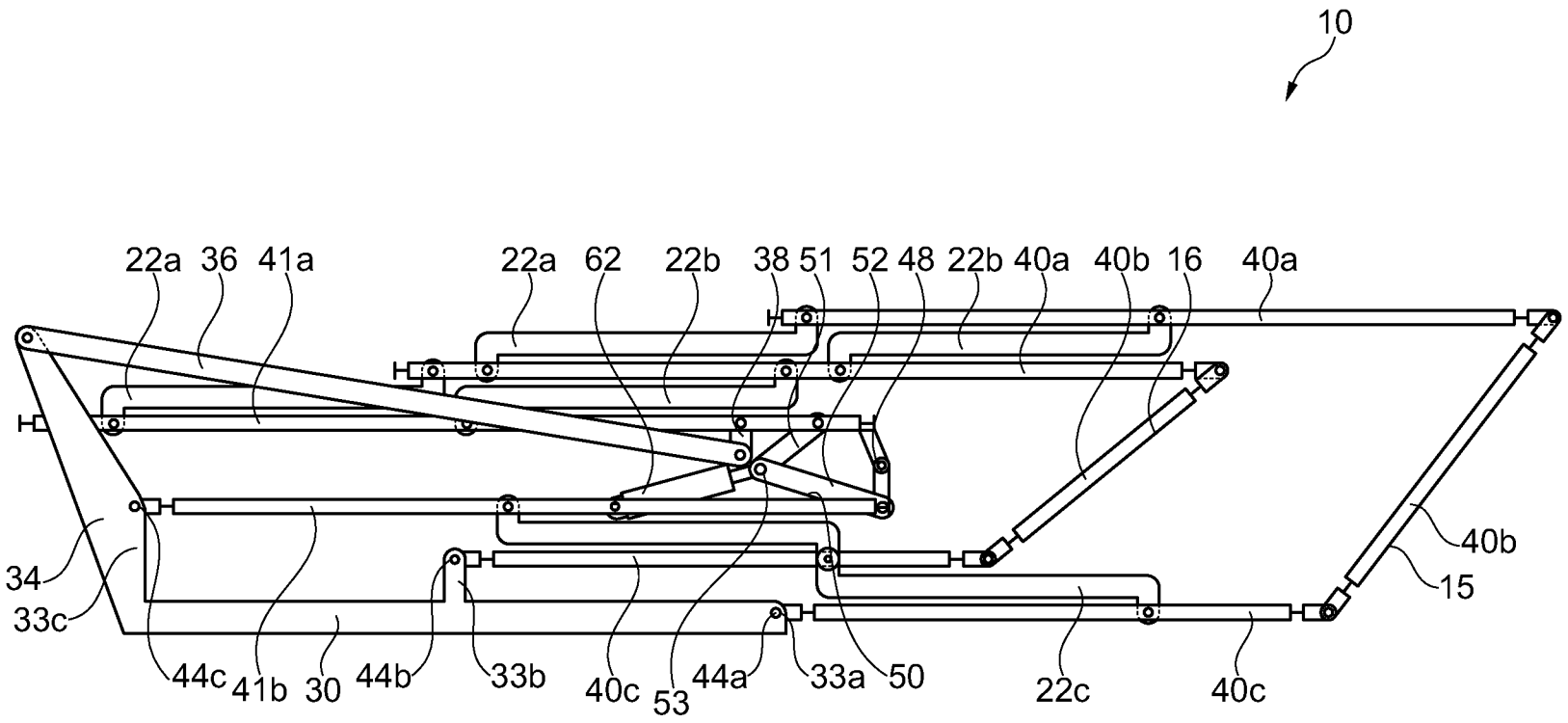
FIG. 4 shows a side view of the folded-up drill rod magazine of FIG. 3.

The outer second side wall 15 is formed similarly to the middle intermediate wall 16 with three wall elements 40. By means of baseboards 33*a*, 33*b*, respectively with horizontal lower pivot bearings 44*a*, 44*b*, the second side wall 15 and the intermediate wall 16 are arranged so that they can be folded on the support area 30. The second side wall 15 and the intermediate wall 16 each have a lower wall element 40*c*, a middle wall element 40*b* and an upper wall element 40*a* which are respectively interconnected via horizontal pivot joints 46 so that they can pivot about a horizontal pivot axis. Furthermore the transverse beams 22 of the receiving shelves 20 are mounted via horizontally orientated joints pivotably on the individual wall elements 40, 41 so that the rod magazine 10 as a whole can be folded up into a collapsed position which is shown in FIGS. 3 and 4. In this collapsed position the individual parts of the drill rod magazine are extensively horizontally orientated, as can be deduced in particular from FIGS. 3 and 4.

For support and additional guidance in the folding movement, a laterally protruding support arm 36 is provided on the support area 30 and forms a unit with the baseboard 33*c* of the first side wall 14. Two rod-like support arms 36 are mounted in a jointed manner on the support 34 via a joint with a horizontal pivot axis. The upper end of the support arms 36 is connected respectively via a coupling lever 38 in a jointed manner to the upper wall element 41*a* of the first side wall 14.

On the lower wall element 41*b* of the first side wall 14 a respective adjusting cylinder 62 of an adjusting cylinder arrangement 60 of the drill rod magazine 10 is arranged in a jointed manner on the outer vertical metal beams 42. The piston end of the two adjusting cylinders 62 that can be moved out is arranged in each case in a jointed manner at an elbow 53 of an elbow lever mechanism 50. The elbow lever mechanism 50 comprises a first elbow lever 51 and a second elbow lever 52 which are interconnected in a jointed manner at the elbow 53. The first elbow lever 51 is thereby arranged on the upper wall element 41*a* of the first side wall 14 and the lower second elbow lever 52 is arranged in a jointed manner on the lower second wall element 41*b* of the first side wall 14. The first wall element 41*a* and the second wall element 41*b* of the first side wall 14 are coupled to each other via a two-part pivot joint mechanism 48 so that they can be pivoted about a horizontal pivot axis.

By means of the adjusting cylinder arrangement 60 the drill rod magazine can be unfolded from the collapsed position according to FIGS. 3 and 4 independently and without an external lifting means into the erected vertical operating opposition according to FIGS. 1, 2 and 5. By moving out the two adjusting cylinders 62, an erection force is exerted via the elbow lever mechanism 60 on the first side wall 14. By means of the support arm 36 the upper wall element 41*a* of the first side wall 14 is additionally supported and guided. The erection movement is transferred from the first wall element 41*a* and the second wall element 41*b* of the first side wall 14 via the transverse beams 22 coupled in a jointed manner to the corresponding wall elements 40 of the intermediate wall 16 and the second side wall 15. The lower transverse beam 22*c* can be designed in one part with a step 23 in the region of the joint connection with the intermediate wall 16. By moving out the adjusting cylinders 62 into their moved-out end position the drill rod magazine 10 is unfolded into the vertical operating position. In the reverse direction, by moving in the two adjusting cylinders 62 of the adjusting cylinder arrangement 60 the drill rod magazine 10 can be folded up again from the operating position into the collapsed position.

In order to achieve a particularly compact arrangement in the collapsed position the individual baseboards 33 are designed with different vertical heights, the height thereof increasing from the first baseboard 33*a* via the second middle baseboard 33*b* to the outer third baseboard 33 counter to the folding direction.

The drill rod magazine 10 is provided for mobile use on mobile drilling rigs, in particular deep drilling rigs, in order to receive a plurality of drill rod elements for the drill rod as close as possible to the drilling rig. In principle the magazine according to the invention can also be used for other purposes for receiving rod-like elements.

The invention claimed is:

1. Drill rod magazine for vertical storage of drill rod elements, said drill rod magazine comprising, a frame that is box shaped, said frame having a support area, vertical side walls and at least one horizontal receiving shelf configured to receive and hold the drill rod elements, wherein the frame has a laterally open access area to receive the drill rod elements inside the frame, wherein the vertical side walls are arranged parallel to each other and each vertical side wall has at least one pivot bearing with a horizontally oriented pivot axis, the at least one horizontal receiving shelf is configured to be pivotable with respect to the vertical side walls, and the frame is configured to be collapsible, wherein the frame can be unfolded from a folded-up collapsed position into an operating position, and wherein an adjusting cylinder arrangement is provided with at least one adjusting cylinder configured to position the frame from the folded-up collapsed position to the operating position.

2. Drill rod magazine according to claim 1, wherein the adjusting cylinder arrangement has at least two adjusting cylinders which are arranged parallel to each other along one of the vertical side walls.

3. Drill rod magazine according to claim 1, wherein each vertical side wall is constructed from at least two wall elements, the pivot bearings are arranged between the at least two wall elements.

4. Drill rod magazine according to claim 3, wherein the at least two wall elements are constructed of a truss formed from metal.

5. Drill rod magazine according to claim 1, wherein the vertical side walls are respectively joined to the support area via a pivot bearing.

6. Drill rod magazine according to claim 1, wherein at least one laterally projecting support is arranged on the support area, wherein a support arm is pivotably mounted to the at least one laterally projecting support.

7. Drill rod magazine according to claim 1, wherein one of the vertical side walls has a first wall element and a second wall element adjacent to the first wall element, the at least one adjusting cylinder is coupled to the first wall element on one side and an elbow lever mechanism with two elbow levers on the other side, one of the elbow levers of the two elbow levers is joined to the first wall element and the other elbow lever of the two elbow levers is joined to the second wall element.

8. Drill rod magazine according to claim 7, further comprising a support arm wherein the support arm is connected directly or via a coupling lever to the second wall element.

9. Drill rod magazine according to claim 1, wherein the frame has at least one vertical intermediate wall which is arranged between and parallel to the vertical side walls.

10. Drill rod magazine according to claim 9, wherein the vertical side wall and the vertical intermediate wall are formed of wall elements, wherein the intermediate wall and one of the vertical side walls are formed with the same number of wall elements, and the other side wall of the vertical side walls is connected to a support arm and has a smaller number of wall elements.

11. Drill rod magazine according to claim 10, wherein the vertical side walls and the at least one vertical intermediate wall are pivotably mounted on the support area via a respective baseboard, each of the respective baseboards have a different height.

12. Drill rod magazine for vertical storage of drill rod elements, said drill rod magazine comprising, a frame that is box shaped, said frame having a support area, vertical side walls and at least one horizontal receiving shelf configured to receive and hold the drill rod elements, wherein the frame has a laterally open access area to receive the drill rod elements inside the frame, wherein the vertical side walls are arranged parallel to each other and each vertical side wall has at least one pivot bearing with a horizontally oriented pivot axis, the at least one horizontal receiving shelf is configured to be pivotable with respect to the vertical side walls, and the frame is configured to be collapsible, wherein the frame can be unfolded from a folded-up collapsed position into an operating position, and wherein the open access area for the drill rod elements is formed on the at least one receiving shelf by tracks, the tracks are cantilevered horizontally away from a transverse beam to the open access area.

* * * * *